US009145233B2

(12) United States Patent
Cerrato

(10) Patent No.: US 9,145,233 B2
(45) Date of Patent: Sep. 29, 2015

(54) MULTIPLE-COMPARTMENT CONTAINER

(71) Applicant: Kraft Foods Group Brands LLC, Northfield, IL (US)

(72) Inventor: Nicole Cerrato, Chicago, IL (US)

(73) Assignee: Kraft Foods Group Brands LLC, Northfield, IL (US)

( * ) Notice: Subject to any disclaimer, the term of this patent is extended or adjusted under 35 U.S.C. 154(b) by 63 days.

(21) Appl. No.: 13/802,137

(22) Filed: Mar. 13, 2013

(65) Prior Publication Data

US 2014/0263354 A1 Sep. 18, 2014

(51) Int. Cl.

| | |
|---|---|
| ***B65D 21/02*** | (2006.01) |
| ***B65D 1/24*** | (2006.01) |
| ***B65D 81/32*** | (2006.01) |
| ***B65D 25/04*** | (2006.01) |

(52) U.S. Cl.

CPC ..... *B65D 25/04* (2013.01)

(58) Field of Classification Search

CPC ..... Y10S 220/909; B65D 81/3216; B65D 81/3205; B65D 5/48002; B65D 81/32; B65D 81/34; B65D 2581/3432; B65D 31/12

USPC ..... 220/23.83, 527, 23.89, 909, 553, 505, 220/510, 516, 518, 520, 525, 847, 524, 555, 220/720; 383/40; 229/904, 400, 120.18, 72, 229/120.13; 426/120

See application file for complete search history.

(56) References Cited

U.S. PATENT DOCUMENTS

| | | | | |
|---|---|---|---|---|
| 3,261,494 | A * | 7/1966 | Walker, Jr. | 220/555 |
| 3,381,875 | A * | 5/1968 | Tunick | 229/120.03 |
| 3,394,861 | A | 7/1968 | Truax | |
| 4,126,261 | A * | 11/1978 | Cook | 229/120.08 |
| D279,865 | S | 7/1985 | McKee | |
| D297,115 | S | 8/1988 | Fontana et al. | |
| D297,116 | S | 8/1988 | Fontana et al. | |
| D297,117 | S | 8/1988 | Fontana et al. | |
| D297,118 | S | 8/1988 | Fontana et al. | |
| D297,119 | S | 8/1988 | Fontana et al. | |
| 4,896,772 | A | 1/1990 | Walter et al. | |
| 4,955,528 | A | 9/1990 | Schluckebier | |
| 4,989,742 | A | 2/1991 | Powell | |
| 4,991,980 | A * | 2/1991 | Cohen et al. | 383/40 |
| 5,111,951 | A * | 5/1992 | Breen et al. | 220/23.4 |
| D339,522 | S | 9/1993 | Zoss | |
| 5,303,841 | A * | 4/1994 | Mezey | 220/555 |
| D351,997 | S | 11/1994 | Finnah | |
| 5,405,030 | A * | 4/1995 | Frazier | 215/6 |
| 5,495,941 | A * | 3/1996 | Leonard | 206/366 |
| D370,412 | S | 6/1996 | Rohrer | |

(Continued)

OTHER PUBLICATIONS

International Search Report and Written Opinion for PCT Application No. PCT/US2014/022394, mail date Jul. 9, 2014, 15 pages.

*Primary Examiner* — Shawn M Braden

(74) *Attorney, Agent, or Firm* — Foley & Lardner LLP

(57) ABSTRACT

A multiple-compartment container includes an upper rim defining an upper plane, a lower rim defining a lower plane, a perimeter wall connecting the upper rim to the lower rim. The perimeter wall forms an outer surface of the container. The container further includes at least one internal wall dividing the container into multiple compartments. An upper edge of the internal wall is an uppermost feature of the container. The upper edge of the internal wall is deformable to present a widened sealing surface during a sealing operation.

20 Claims, 4 Drawing Sheets

(56) References Cited

U.S. PATENT DOCUMENTS

| | | | | |
|---|---|---|---|---|
| D373,081 | S | 8/1996 | Bridger | |
| D376,311 | S | 12/1996 | Burton | |
| D393,798 | S | 4/1998 | Joswick | |
| 5,853,105 | A | 12/1998 | Roman et al. | |
| 5,875,957 | A * | 3/1999 | Yocum | 229/120.22 |
| 5,901,848 | A | 5/1999 | Gorlich et al. | |
| D424,426 | S | 5/2000 | Fletcher | |
| 6,119,930 | A | 9/2000 | Lunstra et al. | |
| 6,260,730 | B1 * | 7/2001 | Fellman | 220/495.02 |
| D492,196 | S | 6/2004 | Hyhlik et al. | |
| D515,437 | S | 2/2006 | Lopez-Garcia | |
| D529,820 | S | 10/2006 | Kissner et al. | |
| 8,474,641 | B2 * | 7/2013 | Hays et al. | 220/23.89 |
| 2001/0035454 | A1 * | 11/2001 | Cai | 229/120.12 |
| 2002/0056743 | A1 * | 5/2002 | Barcat et al. | 229/120.01 |
| 2010/0108686 | A1 | 5/2010 | Reichel | |
| 2013/0024468 | A1 | 1/2013 | Kocsis | |

* cited by examiner

MULTIPLE-COMPARTMENT CONTAINER

BACKGROUND

The present disclosure relates generally to the field of containers for food products, and more particularly to a multiple-compartment container for separating two or more food products within a single package.

In the past, multi-compartment containers have been used for packaging complementary food products (e.g., cheese and crackers, chips and salsa, cottage cheese and fruit, etc.). One of the food products is contained within a first compartment and the complementary food product is contained within a second compartment. Conventional containers often include an upper rim to which a removable cover or lid is attached. Typically, the cover is bonded or sealed to the upper rim after the container is filled.

Conventional containers suffer from the disadvantage that the cover often fails to adequately separate the first compartment from the second compartment. For example, the cover may be bonded to an outer perimeter of the container without providing an airtight seal between compartments. The lack of an airtight seal between compartments can result in moisture from one compartment undesirably equilibrating into another compartment.

SUMMARY

One embodiment of the present disclosure is a multiple-compartment container including an upper rim defining an upper plane, a lower rim defining a lower plane, a perimeter wall connecting the upper rim to the lower rim, and at least one internal wall extending upward from the lower plane and dividing the container into multiple compartments. The perimeter wall forms an outer surface of the container and an upper edge of the internal wall is an uppermost feature of the container.

In some embodiments, the container further includes a first bottom surface and a second bottom surface. The first bottom surface defines a lower boundary of the first compartment and a second bottom surface defines a lower boundary of the second compartment. The first bottom surface is substantially coplanar with the lower plane and the second bottom surface defines a middle plane between the upper plane and the lower plane. The internal wall has a generally arcuate cross-section and intersects the perimeter wall at an oblique angle.

Another embodiment of the present disclosure is a multiple compartment container including a first compartment having a first open face and a second compartment having a second open face. The first open face and the second open face define a first plane. The first compartment and the second compartment are separated by a shared internal wall extending through the first plane. A portion of the internal wall is configured to flatten into alignment with the first plane when at least one of a heat and a pressure is applied to an edge thereof.

In some embodiments, the first plane defines an upper boundary for all features of the container other than the internal wall. The first compartment and the second compartment may be bounded at least partially by a perimeter wall forming an exterior surface of the container. A first section of the perimeter wall may bound the first compartment and a second section of the perimeter wall may bound the second compartment. The first section and the second section of the perimeter wall may be continuously connected and have a single radius of curvature throughout both sections.

Another embodiment of the present disclosure is a multiple-compartment container including a base, a perimeter wall extending upward from the base, and an internal wall extending upward from the base. The perimeter wall forms a closed outer surface of the container and the internal wall intersects the perimeter wall in two or more locations, thereby dividing the container into a first compartment and a second compartment. The internal wall is configured to bend in a predictable manner for sealing purposes when a downward force is applied to an upper edge thereof.

In some embodiments, the internal wall extends upward from the base and protrudes from an open top face of the container. An upper edge of the internal wall is an uppermost feature of the container. The internal wall may have a complex cross-section in a plane parallel to the base. The complex cross-section may include a first segment having a first radius of curvature and a second segment having a second radius of curvature different than the first radius of curvature. In some embodiments, the complex cross-section further includes a third segment having a third radius of curvature different than the first radius of curvature and the second radius of curvature. In some embodiments, the internal wall is planar or substantially planar.

Another embodiment of the present disclosure is a dual-compartment container including an upper rim defining an upper plane, a lower rim defining a lower plane, a perimeter wall connecting the upper rim to the lower rim and forming an outer surface of the container, and an internal wall extending upward from the lower plane and dividing the container into a first compartment and a second compartment. An upper edge of the internal wall is an uppermost feature of the container and an upper portion of the internal wall is deformable to present a widened sealing surface. In some embodiments, the upper portion of the internal wall is deformable during a sealing operation, a deformation process occurring prior to a sealing operation, or any combination thereof.

In some embodiments, the internal wall has an optimal thickness for balancing a reduced flexure of the internal wall when the upper portion of the internal wall is deformed with a manufacturability of the multiple-compartment container. In some embodiments, the optimal thickness of the internal wall is at least 0.6 millimeters. In some embodiments, the optimal thickness of the internal wall is between 0.6 millimeters and 1.2 millimeters. In some embodiments, the optimal thickness of the internal wall is expressed as an optimal width-to-thickness ratio, where a width used in the width-to-thickness ratio is a distance between opposing surfaces of the perimeter wall intersected by the internal wall. In some embodiments, the optimal width-to-thickness ratio is between 40:1 and 50:1.

The foregoing is a summary and thus by necessity contains simplifications, generalizations, and omissions of detail. Consequently, those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

DETAILED DESCRIPTION

Referring generally to the figures, a multiple-compartment container and components thereof are shown and described, according to various exemplary embodiments. Before discussing further details of the multiple compartment container and/or the components thereof, it should be noted that references to "front," "back," "rear," "upward," "downward," "inner," "outer," "right," and "left" in this description are merely used to identify the various elements as they are oriented in the figures. These terms are not meant to limit the element which they describe, as the various elements may be oriented differently in various applications.

Figure 1:
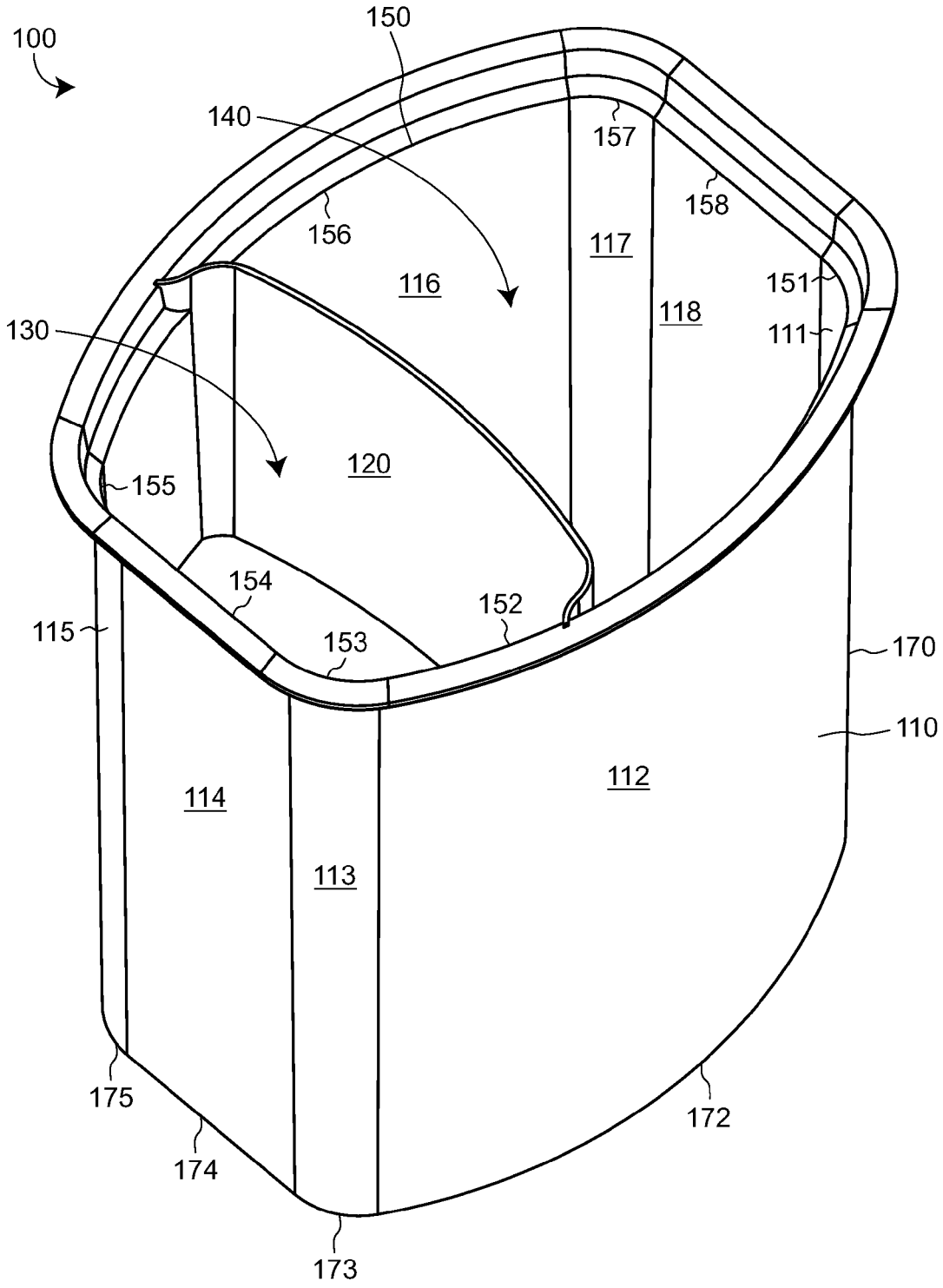
FIG. 1 is a perspective view of a multiple-compartment container, according to an exemplary embodiment.

Referring now to FIG. 1, a perspective view of the multiple-compartment container 100 is shown, according to an exemplary embodiment. Container 100 is shown to include a perimeter wall 110 and an internal wall 120. Internal wall 120 is shown dividing an open volume within container 100 into a first compartment 130 and a second compartment 140. In some embodiments, container 100 is a dual-compartment container. In other embodiments, container 100 may include a third compartment, a fourth compartment, or any number of additional compartments.

In some implementations, container 100 may be used for packaging food products. The multiple-compartment configuration allows for packaging two separate food product components in a single container. The food product components may be complementary foods (e.g., cottage cheese and fruit, cheese and crackers, chips and salsa, cheese and breadsticks, etc.) non-complementary foods, (e.g., pudding and yogurt, cream cheese and sour cream, etc.), a combination of a food and a beverage (e.g., milk and cookies, juice and crackers, etc.), a food product and a non-food product (e.g., crackers and a toy, fruit and a written note, etc.) or any other combination of foods, beverages, and non-food products. Although the present disclosure describes container 100 in the context of food packaging, various alternative uses are possible. For example, the container may be used for packaging or storing reactive ingredients, laboratory chemicals, office supplies (e.g., paper clips, pencils, stamps, etc), commonly used condiments (e.g., salt and sugar, ketchup and mustard, etc.), or any other combination of items.

Advantageously, the multiple-compartment configuration allows for packaging food products or other items having different moisture levels or moisture requirements. For example, compartment 140 may be used to package a dry item (e.g., crackers, breadsticks, chips, etc.) while compartment 130 may be used to package a moist item (e.g., cream cheese, salsa, cottage cheese, etc.). Although several illustrative examples of dry and moist items are provided, these examples are intended to be non-limiting. Container 100 may be used to package any dry item with any moist item. Internal wall 120 provides a moisture barrier between compartment 130 and compartment 140, thereby preventing moisture from the moist item from equilibrating into the dry item.

In some embodiments, container 100 may be manufactured (e.g., molded, cast, assembled, etc.) from a polymeric or elastomeric material (e.g. polypropylene, polyethylene, polystyrene, etc.). In other embodiments, container 100 may be manufactured from metals, ceramics, textiles, glass, or any other suitable material or combination of materials. The material(s) for container 100 may be selected from a group of materials which are impermeable or substantially impermeable to moisture. In some embodiments, container 100 is manufactured from a polymeric material using an injection molding process. For example, a liquid resin may be injected into a mold forming the general shape and features of container 100. Container 100 may be tapered to facilitate release of the solidified container from the mold.

Still referring to FIG. 1, container 100 is further shown to include an upper rim 150 and a lower rim 170. Upper rim 150 may extend along one or more upper edges of container 100. In some embodiments, upper rim 150 includes a plurality of upper rim segments (e.g., rim segments 151-158). Rim segments 154 and 158 are shown as generally linear rim segments. Rim segments 154,158 may be substantially parallel and/or may define opposite edges of upper rim 150. In some embodiments, rim segments 154,158 may be curved rim segments having equal or differing radii of curvature. Rim segments 152 and 156 are shown as curved rim segments having equal radii of curvature. However, in other embodiments, rim segments 152, 156 may be linear or have differing radii of curvature.

Rim segments 151, 153, 155, and 157 are shown as curved transition segments. For example, rim segment 151 is shown connecting rim segment 152 with rim segment 158, rim segment 153 is shown connecting rim segment 152 with rim segment 154, rim segment 155 is shown connecting rim segment 154 with rim segment 156, and rim segment 157 is shown connecting rim segment 156 with rim segment 158. In some embodiments, two or more of rim segments 151-158 may be combined into a single segment. The combined segment may be linear or have one or more radii of curvature. In some embodiments, rim segments 151-158 may combine to form a closed shape. The closed shape may define an upper perimeter of container 100. In some embodiments, the upper rim segments are generally coplanar, thereby defining an upper plane 180 (shown in FIG. 4).

Lower rim 170 may extend along one or more lower edges of container 100. In some embodiments, lower rim 170 includes a plurality of rim segments (e.g., rim segments 172-175, other rim segments not shown, etc.) which combine to form a closed shape. The closed shape may define a lower perimeter or base of container 100. The plurality of lower rim segments may be substantially coplanar, thereby defining a lower plane 190 (shown in FIG. 4). Lower plane 190 may be parallel or substantially parallel to upper plane 180. In some embodiments, upper rim 150 and lower rim 170 circumscribe an equal area. In other embodiments, upper rim 150 circumscribes a greater area or lesser area than lower rim 170.

Still referring to FIG. 1, perimeter wall 110 may connect upper rim 150 with lower rim 170, thereby forming an outer surface of container 100. In some embodiments, perimeter wall 110 may include a plurality of surfaces (e.g., surfaces 111-118). Surfaces 111-118 may connect one or more segments of upper rim 150 with one or more segments of lower rim 170. For example, surface 112 is shown connecting upper rim segment 152 with lower rim segment 172, surface 113 is shown connecting upper rim segment 153 with lower rim segment 173, surface 114 is shown connecting upper rim segment 154 with lower rim segment 174, and surface 115 is shown connecting upper rim segment 155 with lower rim segment 175.

Surfaces 114 and 118 are shown as generally flat surfaces forming opposite sides of container 100. In some embodiments, surfaces 114 and 118 may be parallel. In other embodiments, surfaces 114, 118 may be non-parallel or have one or more radii of curvature (e.g., vertically curved, horizontally curved, spherically curved, etc.). Surfaces 112 and 116 are shown as curved surfaces having a horizontal radius of curvature (e.g., curved along a horizontal arc) and forming opposite sides of container 100.

In some embodiments, the plurality of surfaces 111-118 may combine (e.g., intersect, merge, overlap, connect, etc.) to form a closed perimeter wall 110. The combination of surfaces 111-118 may occur along one or more edges having an angle of intersection (e.g., a right angle, an oblique angle, etc.), a rounded transition (e.g., a fillet, chamfer, curved surface, etc.), or any other transition between surfaces. In some embodiments, two or more of surfaces 111-118 may be combined into a single surface. The combined surface may be generally flat or have one or more radii of curvature. Perimeter wall 110 may extend upward from lower rim 170 and terminate upon connecting with upper rim 150. In other words, perimeter wall 110 may be vertically bounded by upper plane 180 and lower plane 190. The vertical distance between upper plane 180 and lower plane 190 (or between upper rim 150 and lower rim 170) may define a first height.

Still referring to FIG. 1, internal wall 120 may intersect perimeter wall 110 and divide container 100 into a first compartment 130 and a second compartment 140. Internal wall 120 may intersect perimeter wall 110 in one location (e.g., along an edge, line, etc.) or in a plurality of locations (e.g., extending between two or more surfaces of perimeter wall 110). In some embodiments, internal wall 120 may be generally vertical, thereby dividing container 100 into horizontally adjacent (i.e., side-by side) compartments. In other embodiments, internal wall may divide container 100 into vertically adjacent or otherwise oriented compartments.

Compartments 130,140 may be externally bounded by perimeter wall 110. In some embodiments, a single surface of perimeter wall 110 forms an external boundary of both compartments 130,140. For example, surface 112 is shown as an external side boundary of both first compartment 130 and second compartment 140. The shared external surface may be continuous (e.g., flat or continuously curved) along a side of both compartments 130,140. Compartments 130,140 may be internally bounded by internal wall 120. Internal wall 120 may be a shared boundary (e.g., a single wall, surface, divider, etc.) separating first compartment 130 from second compartment 140. Internal wall 120 may be horizontally surrounded by perimeter wall 110.

Figure 2:
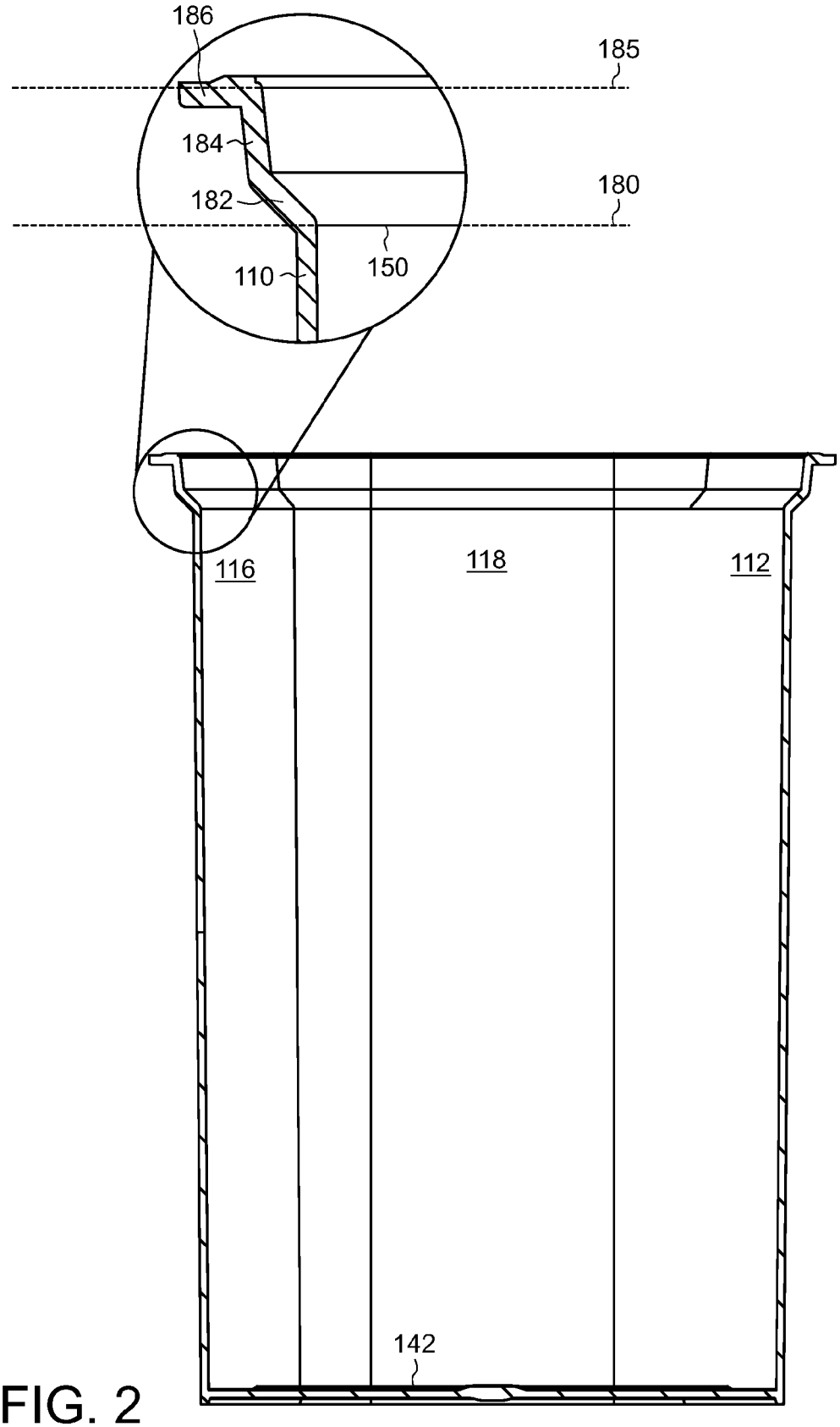
FIG. 2 is a front cross-sectional view of the multiple-compartment container, according to an exemplary embodiment.

Referring now to FIG. 2, a front cross-sectional view of container 100 is shown, according to an exemplary embodiment. Container 100 is shown to include a shoulder 182, a neck 184, and a flange 186. Shoulder 182 may be a surface extending from upper rim 150 along one or more of rim segments 151-158. In some embodiments, shoulder 182 extends from upper rim 150 along an entire perimeter thereof. Shoulder 182 may extend outward from rim 150 completely horizontally (e.g., within plane 180) or at an angle (e.g., above or below plane 180). In the exemplary embodiment shown in FIG. 2, shoulder 182 extends upward and outward from rim 150. Shoulder 182 may allow container 100 to be gripped, carried, held, or otherwise manipulated during an automated filling or packaging process.

Neck 184 may be a surface extending from an edge of shoulder 182. In some embodiments, neck 184 extends from shoulder 182 along an entire perimeter thereof. Neck 184 may extend from shoulder 182 horizontally, vertically, or at an oblique angle. In the exemplary embodiment shown in FIG. 2, neck 184 extends upward substantially vertically from shoulder 182. In some embodiments, shoulder 182 and neck 184 may be combined into a single component or replaced with a continuously curved or angled surface. In other embodiments, neck 184 may extend directly from rim 150 in addition to, or replacing shoulder 182.

Flange 186 may be a surface extending from an upper edge of neck 184. In some embodiments, flange 186 extends from neck 184 along an entire perimeter thereof. In other embodiments, flange 186 extends directly from shoulder 182 or from rim 150. Flange 186 may extend from neck 184, shoulder 182, or rim 150 in a horizontally outward direction. Flange 186 may provide a horizontal surface onto which a lid, cover, seal, or other packaging element may be affixed (e.g., melted, bonded, pressed, etc.) during a hermetic sealing process. Flange 186 may define a horizontal plane 185. Plate 185 may be coplanar with plane 180 or above plane 180.

Figure 3:
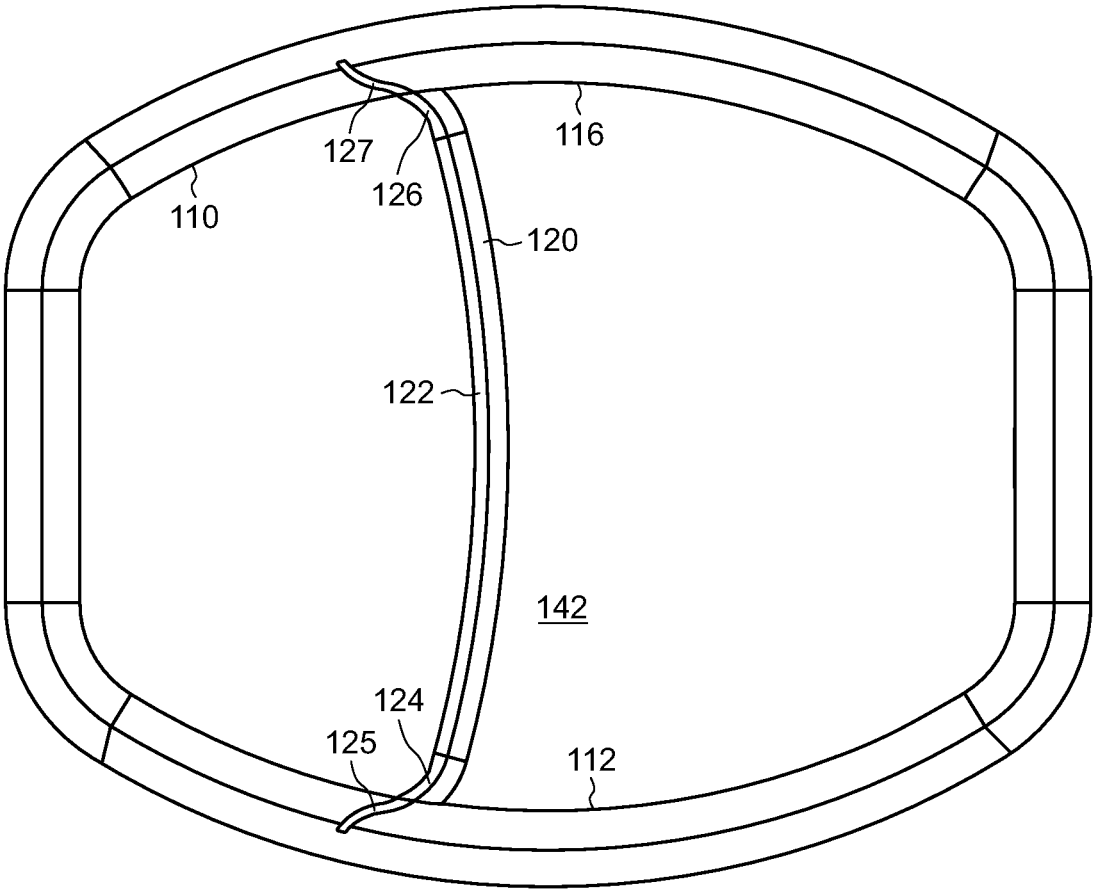
FIG. 3 is a plan view of the multiple-compartment container, according to an exemplary embodiment.

Referring now to FIG. 3, a plan view of container 100 is shown, according to an exemplary embodiment. Internal wall 120 is shown to have a generally arcuate (e.g., arc-shaped, bow-shaped, curved, etc.) cross-section when viewed from above (e.g., in a plane parallel to upper plane 180 or lower plane 190). Advantageously, the arcuate cross section of internal wall 120 may cause internal wall 120 to deform (e.g., bend, buckle, bulge, expand, etc.) in a predictable manner when a downward force is applied to an upper edge thereof. For example, during a packaging process, a lid may be applied to container 100 along upper rim 150. The lid may be pressed and/or melted onto upper rim 150 using a mechanical device such as a hermetic sealing device. Pressure applied by the device may be concentrated along an upper edge of internal wall 120, thereby causing internal wall 120 to bend or buckle. The arcuate shape of internal wall 120 may predispose internal wall 120 to deform in a predictable manner (e.g., bending in a predictable direction, at a predictable angle, in a predictable location, etc.).

In some embodiments, the thickness of internal wall 120 is optimized to reduce flexing (e.g., bending, buckling, etc.) without sacrificing the moldability of container 100. For example, if internal wall 120 is too thin, internal wall 120 may be prone to excessive flexure. However, increasing the thickness of internal wall 120 may require additional resin and may negatively impact the moldability (e.g., resin flow, container formation, etc.) of container 100 during an injection molding process. In some embodiments, the optimal thickness of internal wall 120 may be at least 0.6 millimeters (mm). In some embodiments, the optimal thickness of internal wall 120 may be at least 0.8 mm In some embodiments, the optimal thickness of internal wall 120 may be with a range from 0.6 mm to 1.2 mm. In some embodiments, the optimal thickness of internal wall 120 may be with a range from 0.8 mm to 1.2 mm. In some embodiments, the optimal thickness of internal wall 120 may be approximately 1.0 mm. However, other thickness dimensions may be used in other embodiments, such as when overall size of the container or portions of the container changes, etc.

In some embodiments, the optimal thickness of internal wall 120 relative to the overall size of the container may be expressed as a width-to-thickness ratio. The width of internal wall 120 may be defined by the distance between the locations at which internal wall 120 intersects perimeter wall 110 (e.g., between surfaces 112,116), or in some embodiments, the distance between transition surfaces 124 and 126. In some embodiments, the optimal width-to-thickness ratio may be with a range from approximately 40:1 to 50:1. In some embodiments, the optimal width-to-thickness ratio may be approximately 45:1.

Figure 4:
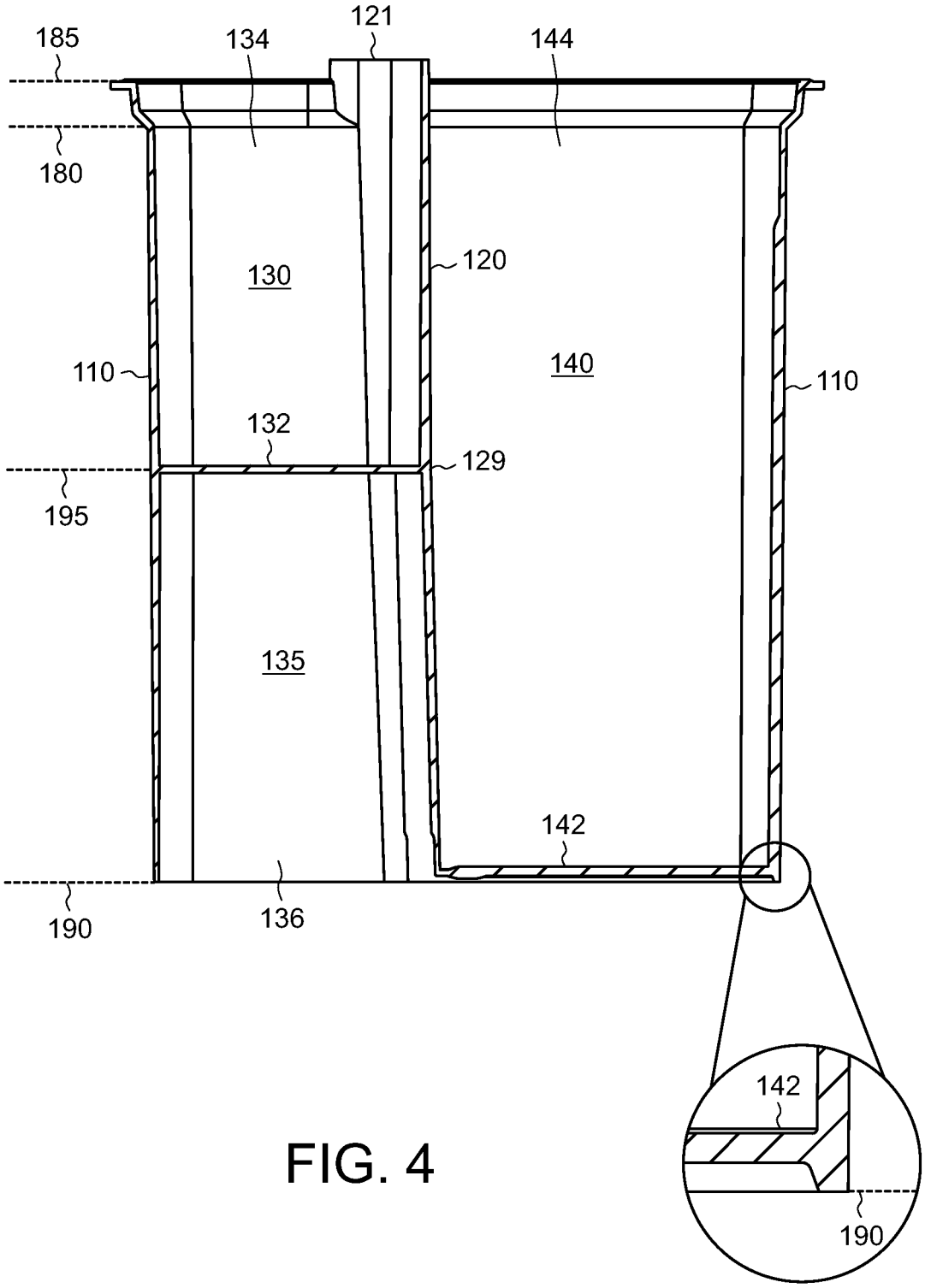
FIG. 4 is a side cross-sectional view of the multiple compartment container, according to an exemplary embodiment.

In some embodiments, the optimal thickness of internal wall 120 may be expressed as a height-to-thickness ratio. The height of internal wall 120 may be defined by the distance between an upper edge of internal wall 120 and a lower edge of internal 120 (e.g., a distance between upper edge 121 and lower edge 123 as shown in FIG. 4). In some embodiments, the optimal height-to-thickness ratio may range from 70:1 to 90:1. In some embodiments, the optimal height-to-thickness ratio may be approximately 82:1.

Advantageously, the ability to predict any potential deformation of internal wall 120 allows other features of container 100 to be designed in anticipation of such deformation. For example, internal wall 120 is shown to include a plurality of surfaces 122-127. Surface 122 is shown as a primary surface having a first radius of curvature and comprising a majority of the surface area of internal wall 120. Surface 124 may be a transition surface connecting surface 122 with perimeter wall 110. In some embodiments, the transition between surface 124 and surface 122 may be smooth or continuous. Such a smooth or continuous interface is also intended to facilitate the ease of removing the contents (e.g. cream cheese, etc.) from the compartment. In other embodiments, surface 124 may intersect surface 122 at an angle of intersection.

Surface 124 may have a second radius of curvature different from the first radius of curvature. The second radius of curvature may be selected such that surface 124 intersects perimeter wall 110 at an optimal angle. In some embodiments, the optimal angle of intersection may be between 30 degrees and 60 degrees. In more specific embodiments, the angle of intersection may be between 40 degrees and 50 degrees. In further embodiments, the angle of intersection may be approximately 45 degrees. The second radius of curvature necessary to achieve the optimal angle of intersection may be based on the horizontal length of surface 122 relative to the dimensions of perimeter wall 110. The optimized transition between internal wall 120 and perimeter wall 110 may provide structural reinforcement for container 100 during hermetic sealing. The structural reinforcement may prevent container 100 from rupturing and may ensure the integrity of the moisture barrier between compartments 130,140.

Still referring to FIG. 3, internal wall 120 is shown to include a shoulder transition surface 125. As is most clearly illustrated in FIG. 1, shoulder transition surface 125 may connect an upper portion of surface 124 with shoulder 182, neck 184 and/or flange 186. Surface 125 may extend from surface 124 above rim 150 in a horizontally outward direction. Surface 125 may complete the barrier between compartments 130,140, thereby ensuring proper separation of the items contained therein. Surface 125 may have a third radius of curvature. The third radius of curvature may be equal to or different from any or all of the first and second radii of curvature. The third radius of curvature may be selected such that surface 125 intersects shoulder 182 and/or neck 184 at an optimal angle. The optimal angle may be equivalent to the angle of intersection between surface 124 and perimeter wall 110.

In some embodiments, internal wall 120 intersects perimeter wall 110 in two or more locations. In such embodiments, internal wall 120 may have two or more perimeter transition surfaces 124,126 and two or more shoulder transition surfaces 125,127. For example, surface 124 may intersect surface 112 and surface 126 may intersect surface 116. Surface 125 may extend from surface 124 and surface 127 may extend from surface 126. Surfaces 125,127 may connect surfaces 124,126 with shoulder 182 and neck 184. The radii or curvature of surfaces 124,126 may be selected to achieve an optimal angle of intersection with surfaces 112,116. Surfaces 124,126 may have equal or different radii of curvature and equal or different horizontal lengths (e.g., based on the size and orientation of surface 122) for achieving the optimal angle of intersection with surfaces 112,116. Similarly, the radii of curvature of surfaces 125,127 may be selected to achieve an optimal angle of intersection with shoulder 182 and neck 184. Surfaces 125,127 may have equal or different radii of curvature and equal or different horizontal lengths for achieving the optimal angle of intersection.

Referring now to FIG. 4, a half-sectional side view of container 100 is shown, according to an exemplary embodiment. Internal wall 120 is shown dividing container 100 into a first compartment 130 and a second compartment 140. Compartment 130 is shown having an open top face 134 and a closed bottom surface 132. In some embodiments, bottom surface 132 defines a middle plane 195 between plane 180 and plane 190. Surface 132 may form a barrier between compartment 130 and a volume of empty space 135 below compartment 130. In some embodiments, perimeter wall 110 extends between plane 180 and plane 190 along an entire perimeter of upper rim 150 and along an entire perimeter lower rim 170. Advantageously, such extension of perimeter wall 110 may completely conceal (e.g., horizontally surround) empty space 135 when container 100 is placed upright on a flat surface.

The extension of perimeter wall 110 along an entire perimeter of container 100 may also provide a supportive base for container 100. For example, compartment 130 may be filled with a first material (e.g., cheese, dip, salsa, etc.) having a density significantly greater than the density of a material occupying compartment 140 (e.g., crackers, chips, breadsticks, etc.). The greater density of the material in compartment 130 may cause the horizontal center of mass for the filled container 100 to be below compartment 130 notwithstanding the potentially smaller volume of compartment 130. The wide base provided by the complete extension of perimeter wall 110 may circumscribe the horizontal center of mass, thereby preventing container 100 from tipping when resting upright on a flat surface.

Still referring to FIG. 4, compartment 140 is shown to include an open top face 144 and a closed bottom surface 142. In some embodiments bottom surface 142 is coplanar with lower plane 190. In other embodiments, bottom surface may be vertically offset above plane 190. The volume of empty space between surface 142 and plane 190 may be less than the volume of empty space 135. In some embodiments, bottom surface 142 bounds only compartment 140. A lower face 136 of empty space 135 may be open or unbounded. In other embodiments, bottom surface 142 may bound both compartment 140 and empty space 135.

Still referring to FIG. 4, in some embodiments, internal wall 120 is vertical or substantially vertical. In other embodiments, internal wall 120 may be horizontally slanted or angled. For example, internal wall 120 may have an upper edge 121 and a lower edge 123. Upper edge 121 may be horizontally offset from lower edge 123. In further embodiments, internal wall 120 may have a curved vertical cross-section. For example, upper edge 121 and lower edge 123 may be horizontally offset from a midpoint 129 of internal wall 120. Internal wall 120 may have an arcuate vertical cross-section having one or more radii of curvature.

In some embodiments, lower edge 123 is coplanar with lower plane 190. In other embodiments, lower edge 123 may be coplanar with bottom surface 142 or another horizontal plane. Internal wall 120 extends upward from lower edge 123 to upper edge 121. In some embodiments, upper edge 121 is located above both plane 180 and plane 185. In other words, internal wall 120 may extend upward from lower edge 123 to a height that is above upper rim 150, flange 186, or any other component of container 100. Upper edge 121 may be an uppermost feature of container 100 that projects beyond upper rim 150 and flange 186. Internal wall 120 may have a height exceeding the combined heights of perimeter wall 110, shoulder 182, neck 184, and flange 186.

Advantageously, the vertical extension of internal wall 120 above flange 186 may improve the ability of container 100 to provide a hermetic seal between compartments 130,140. For example, during packaging, a lid (e.g. a layer formed of a foil-based substrate, a layer formed of a polymer-based substrate, etc.) may be applied to container 100. The lid may be pressed and/or melted onto flange 186 and upper edge 121 using a mechanical packaging device (e.g., heated platen, a hermetic sealing device, etc.). Because upper edge 121 extends above any other component of container 100, pressure and/or heat applied by the packaging device may be concentrated along upper edge 121, thereby causing an upper portion of internal wall 120 to deform (e.g. flatten, yield, melt, soften, bend, etc.). The deformation may cause upper edge 121 to generally flatten into a "T," "L," or "C" shape, thereby increasing the surface area of internal wall 120 to which the lid may attach (e.g., bond, seal, unite, etc.). The larger surface area is intended to increase the strength of the bond between the lid and internal wall 120, resulting in an improved (e.g., more resilient, tighter, stronger, etc.) moisture barrier between compartments 130,140. The extended height by which upper edge 121 extends beyond the other portions of container 100 may be any suitable height that results in deformation to create a widened sealing interface with the lid material. According to one embodiment, the extended height is within a range of 0.1-0.3 mm, and more particularly, approximately 0.2 mm, although other extended heights may be used depending on the container material, lid material, desired sealing interface characteristics, etc.

In some embodiments, the deformation of upper edge 121 may be concurrent with a hermetic sealing step in the packaging process. For example, upper edge 121 may be widened or flattened as a lid is bonded to upper edge 121 and/or flange 186. In other embodiments, the deformation of upper edge 121 may occur prior to the hermetic sealing step. For example, upper edge 121 may be pre-widened or pre-flattened before compartments 130,140 are filled or before a lid is applied to container 100. Advantageously, the deformation of upper edge 121 may occur at any stage prior to or during the packaging process.

According to any exemplary embodiment, a multiple compartment container is provided for use with food products having different densities or moisture levels, and includes a dividing wall that separates the container into at least two compartments. Advantageously, the dividing wall has an arcuate shape that facilitates sealing by deforming under pressure in a predictable and repeatable manner, and provides a smooth transition with the container's outer wall to improve container wall integrity and enhance the ease of removing (e.g. spooning, scooping, etc.) the food product from a compartment. The extended height of the dividing wall also provides a region intended to intentionally deform (e.g. widen, flatten) under heat or pressure during a sealing operation to enhance the seal interface with a lid material and substantially reduce or prevent migration of moisture from a food product in one compartment to a food product in another compartment.

The construction and arrangement of the elements of the multiple-compartment container as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. The elements and assemblies may be constructed from any of a wide variety of materials that provide sufficient strength or durability, in any of a wide variety of colors, textures, and combinations. Additionally, in the subject description, the word "exemplary" is used to mean serving as an example, instance, or illustration. Any embodiment or design described herein as "exemplary" is not necessarily to be construed as preferred or advantageous over other embodiments or designs. Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

The order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the scope of the appended claims.

What is claimed is:

1. A multiple-compartment container comprising:

an upper rim defining an upper plane;

a lower rim defining a lower plane;

a perimeter wall connecting the upper rim to the lower rim and forming an outer surface of the container;

at least one internal wall dividing the container into at least a first compartment and a second compartment, wherein an upper edge of the at least one internal wall is an uppermost feature of the container and wherein an upper portion of the at least one internal wall is deformable to present a widened sealing surface during a sealing operation;

a first bottom surface defining a lower boundary of the first compartment, wherein the first bottom surface is substantially coplanar with the lower plane; and a second bottom surface offset from the first bottom surface and defining a lower boundary of the second compartment, wherein the second bottom surface defines a middle plane between the upper plane and the lower plane and divides the second compartment into a top compartment and a bottom compartment;

wherein the top compartment has an open face coplanar with the upper plane and the bottom compartment has an open face coplanar with the lower plane.

2. The container of claim 1, wherein the upper rim and the lower rim form closed shapes and wherein the perimeter wall connects the upper rim to the lower rim along an entire perimeter of the upper rim and along an entire perimeter of the lower rim.

3. The container of claim 1, wherein both of the upper rim and the lower rim include a first edge and a second edge and wherein the perimeter wall includes a first side surface and a second side surface, wherein the first side surface connects the first edge of the upper rim to the first edge of the lower rim and wherein the second side surface connects the second edge of the upper to the second edge of the lower rim, and wherein the at least one internal wall intersects the first side surface and the second side surface.

4. The container of claim 1, wherein the at least one internal wall has a generally arcuate cross section in a plane parallel to the upper plane and intersects the perimeter wall at an oblique angle.

5. The container of claim 1, wherein the at least one internal wall is a shared boundary of the first compartment and the second compartment.

6. A multiple compartment container comprising:

a first compartment having a first open face; and a second compartment having a second open face, wherein the first open face and the second open face define a first plane a first bottom surface defining a lower boundary of the first compartment, wherein the first bottom surface is substantially coplanar with a second plane; and a second bottom surface offset from the first bottom surface and defining a lower boundary of the second compartment, wherein the second bottom surface defines a third plane between the first plane and the second plane and divides the second compartment into a top compartment and a bottom compartment;

wherein the top compartment has the second open face coplanar with the first plane and the bottom compartment has a third open face coplanar with the second plane;

wherein the first compartment and the second compartment are separated by a shared internal wall extending through the first plane, wherein a portion of the internal wall is deformable during a sealing operation to provide an enhanced sealing interface with a lid material, wherein the first plane defines an upper boundary for all features of the container other than the internal wall.

7. The container of claim 6, further comprising:

a flange extending from one or more external edges of the first open face or second open face, wherein the flange is coplanar with the first plane.

8. The container of claim 6, wherein the first compartment has a first closed face opposite the first open face and the second compartment has a second closed face opposite the second open face, wherein the first closed face defines the second plane and wherein the second closed face defines the third plane offset from the second plane.

9. The container of claim 6, wherein the first compartment and the second compartment are bounded at least partially by a perimeter wall forming an exterior surface of the container, wherein a first section of the perimeter wall bounds the first compartment and a second section of the perimeter wall bounds the second compartment, wherein the first section and the second section are continuously connected.

10. The container of claim 9, wherein the perimeter wall has a single radius of curvature throughout the first section and the second section.

11. The container of claim 9, wherein the internal wall has a generally arcuate cross section in a plane parallel to the first plane and intersects the perimeter wall at an oblique angle.

12. A multiple-compartment container comprising:

a base;

a perimeter wall extending upward from the base, wherein the perimeter wall forms a closed outer perimeter of the container; and an internal wall intersecting the perimeter wall in at least a first location and a second location and dividing the container into at least first and second compartments, the internal wall having a substantially flat upper edge that extends from the first location to the second location;

the first compartment having a first open top and a closed bottom formed by the base and a substantially constant cross-sectional shape extending from the base to the first open top;

the second compartment having a second open top coplanar with the first open top and a closed bottom formed by an intermediate bottom wall arranged substantially parallel to the base and disposed at an intermediate location between the base and the second open top, and a substantially constant cross-sectional shape extending from the intermediate bottom wall to the open top;

wherein the base defines an opening spaced beneath the intermediate bottom wall wherein the internal wall extends upward from the base and protrudes from an open top face of the container, wherein an upper edge of the internal wall is an uppermost feature of the container, and wherein the upper edge of the internal wall is deformable to present a widened sealing surface during a sealing operation.

13. The container of claim 12, wherein the internal wall has a generally arcuate cross section in a plane parallel to the base, wherein the arcuate cross section causes the internal wall to bend in a predictable manner when a downward force is applied to an upper edge thereof.

14. The container of claim 12, wherein the internal wall intersects the perimeter wall at an oblique angle.

15. The container of claim 12, wherein the internal wall has a complex cross-section in a plane parallel to the base, wherein the complex cross section includes a first segment having a first radius of curvature and a second segment having a second radius of curvature different than the first radius of curvature.

16. The container of claim 15, wherein the complex cross-section further includes a third segment having a third radius of curvature different than the first radius of curvature and the second radius of curvature.

17. A dual-compartment container comprising:

an upper rim defining an upper plane;

a lower rim defining a lower plane;

a perimeter wall connecting the upper rim to the lower rim and forming an outer surface of the container; and an internal wall extending upward from the lower plane and dividing the container into a first compartment and a second compartment, wherein an upper edge of the internal wall presents a widened sealing surface configured to seal against a cover;

a first bottom surface defining a lower boundary of the first compartment, wherein the first bottom surface is substantially coplanar with the lower plane; and a second bottom surface offset from the first bottom surface and defining a lower boundary of the second compartment, wherein the second bottom surface defines a middle plane between the upper plane and the lower plane and divides the second compartment into a top compartment and a bottom compartment;

wherein the top compartment has an open face coplanar with the upper plane that is configured to be sealed by the cover, and the bottom compartment has an open face coplanar with the lower plane;

wherein the upper edge of the internal wall is an uppermost feature of the container and extends linearly from a first location at which the internal wall intersects the perimeter wall to a second location at which the internal wall intersects the perimeter wall.

18. The container of claim 17, wherein the upper portion of the internal wall is deformable during at least one of a sealing operation and a deformation process occurring prior to a sealing operation.

19. The container of claim 17, wherein the internal wall has a thickness optimized for balancing a reduced flexure of the internal wall when the upper portion of the internal wall is deformed with a manufacturability of the dual-compartment container.

20. The container of claim 17, wherein an upper portion of the internal wall is deformable to present the widened sealing surface.

* * * * *